US009376180B2

(12) United States Patent
Swierkocki et al.

(10) Patent No.: US 9,376,180 B2
(45) Date of Patent: Jun. 28, 2016

(54) RAFT ASSEMBLY COMPONENTS AND METHODS

(71) Applicant: Air Cruisers Company, Wall Township, NJ (US)

(72) Inventors: Thomas W. Swierkocki, Manasquan, NJ (US); Stanley J. Pawlowski, Jr., South River, NJ (US); Cristina Ramos, Asbury Park, NJ (US); Sean M. Blazick, Jackson, NJ (US); Donna Eckert, Brick, NJ (US); Linda Radomski, New Egypt, NJ (US); Alberto González Montes, Chihuahua (MX); Alejandra Gabriela Cardona Erives, Chihuahua (MX); Elizabeth López Reyes, Chihuahua (MX); Rubén Salinas Hinojos, Chihuahua (MX); Adrian Enrique Fernández Manriquez, Chihuahua (MX); Ana Karina Navar Guerra, Chihuahua (MX); Juan Ramón Burciaga Holguín, Chihuahua (MX)

(73) Assignee: Air Cruisers Company, Wall Township, NJ (US)

( * ) Notice: Subject to any disclaimer, the term of this patent is extended or adjusted under 35 U.S.C. 154(b) by 0 days.

(21) Appl. No.: 14/534,236

(22) Filed: Nov. 6, 2014

(65) Prior Publication Data

US 2015/0126085 A1 May 7, 2015

Related U.S. Application Data

(60) Provisional application No. 61/900,451, filed on Nov. 6, 2013.

(51) Int. Cl.

*B63C 9/04* (2006.01)
*B63B 7/08* (2006.01)

(52) U.S. Cl.

CPC . *B63C 9/04* (2013.01); *B63B 7/082* (2013.01); *B63C 2009/042* (2013.01)

(58) Field of Classification Search

CPC ..... B63B 7/00; B63B 7/08; B63B 7/082; B63B 35/58; B63C 9/00; B63C 9/02; B63C 9/04; B63C 9/08; B63C 2009/042
USPC ..... 441/40, 41; 114/345
See application file for complete search history.

(56) References Cited

U.S. PATENT DOCUMENTS 4,934,301 A * 6/1990 Harding ..... B63B 7/082 114/345
5,397,258 A 3/1995 Switlik (Continued)

FOREIGN PATENT DOCUMENTS

EP 0193276 A1 9/1986
WO 2004067104 A1 8/2004
WO 2009080044 A2 7/2009

OTHER PUBLICATIONS

International Patent Application No. PCT/US2014/064206, Search Report and Written Opinion mailed Jun. 17, 2015.

(Continued)

*Primary Examiner* — Lars A Olson
(74) *Attorney, Agent, or Firm* — Kilpatrick Townsend & Stockton LLP; Dean W. Russell; Kristin M. Crall

(57) ABSTRACT

Embodiments generally to raft assembly components and methods. Specific aspects provide a tape configuration that can assist positioning of raft tubes with respect to one another, as well as positioning a life raft floor with respect to one or more of the raft tubes. The tape configuration may have a base and an extending T-shaped flange.

16 Claims, 13 Drawing Sheets

(56) References Cited

U.S. PATENT DOCUMENTS 5,662,506 A * 9/1997 Reinhardt, Jr. ..... B63C 9/04 114/345
5,875,730 A * 3/1999 Erceg ..... B63B 7/082 114/345

OTHER PUBLICATIONS

International Patent Application No. PCT/US2014/064206, Invitation to Pay Fees and, Where Applicable, Protest Fee dated Feb. 19, 2015.

* cited by examiner

Outboard

Inboard

Outboard

Inboard

Outboard

Inboard

RAFT ASSEMBLY COMPONENTS AND METHODS

CROSS REFERENCE TO RELATED APPLICATIONS

This application claims the benefit of U.S. Provisional Application Ser. No. 61/900,451, filed Nov. 6, 2013, titled "Life Raft TOT and Floor," the entire contents of which are hereby incorporated by reference.

FIELD OF THE DISCLOSURE

Embodiments of the present disclosure relate generally to raft assembly components and methods. Specific aspects provide a tape configuration that can assist positioning of raft tubes with respect to one another, as well as positioning a life raft floor with respect to one or more of the raft tubes.

BACKGROUND

Rafts find various uses. They may be used for recreational activities, such as white-water rafting, dingy boats for shore access on-board larger vessels; life rafts aboard many water-based vehicles; life rafts aboard aircraft; and others. Manufacturing methods for these and other types of rafts typically include manufacture of one or more tubes, and then securement of the one or more tubes to one another. The methods may also include securement of a raft floor to one or more of the tubes.

Such securement has typically been done with a contact cement, which is much like an adhesive or glue. This material is generally strong, but it takes quite some time for drying in between steps. The required drying time (often overnight) can extend the manufacturing time of a raft to up to many days or more. It is thus desirable to provide improved securing components and manufacturing methods.

BRIEF SUMMARY

Embodiments described herein thus provide raft assembly components and methods that provide improved and more efficient manufacturing methods. Specific aspects provide a tape configuration that can assist positioning of raft tubes with respect to one another, as well as positioning a life raft floor with respect to one or more of the raft tubes.

DETAILED DESCRIPTION

The rafts described herein are generally referred to as life rafts, but it should be understood that the components and methods described may be used for the manufacture of any other type of rafts or other structures that includes securing, adhering or otherwise attaching two or more tubes or other shaped structures together. The components and methods described may also be used for securing, adhering, or otherwise attaching one or more structures to a third structure, such as a raft floor.

Figure 1:
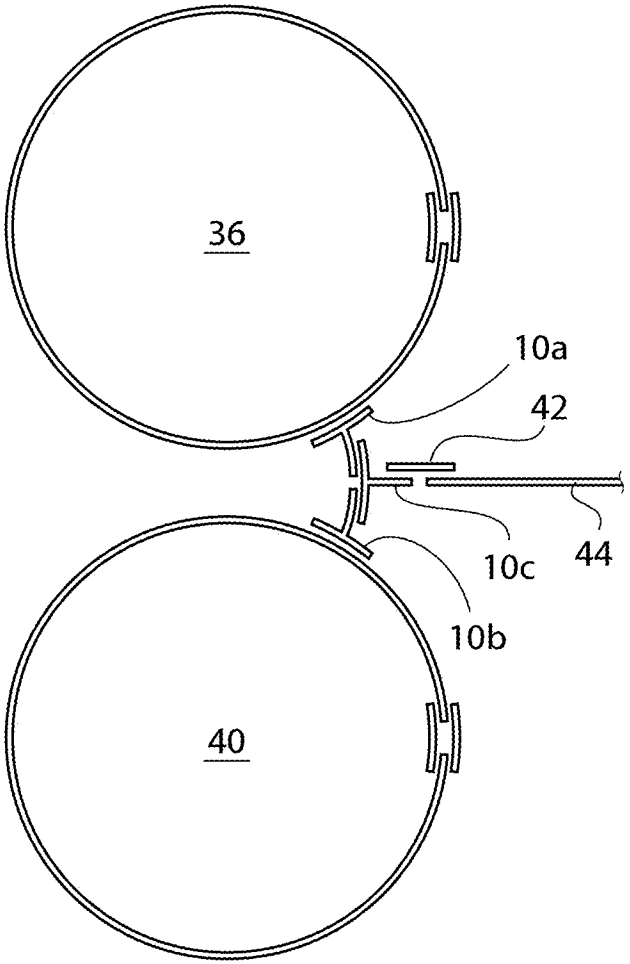
FIG. 1 shows a side schematic view of raft tubes secured via T-tape cooperation and having the raft floor secured via a further T-tape cooperation.

In a general aspect, the features provided relate to a T-shaped configuration 10, which may also be referred to as a "T-tape." FIG. 1 shows three T-tapes 10*a*, 10*b*, and 10*c* in use. Two of the T-tapes 10*a*, 10*b* are used to secure raft tubes 36, 40 to one another, as well as to provide a substrate to which a third T-tape 10*c* can secure. The third T-tape 10*c* is used to secure the raft floor 44 to the substrate formed by the first two T-tapes.

As shown in FIGS. 2A-2D, in one embodiment, a T-tape configuration 10 may be designed from two portions 12, 14 that are folded and bonded to one another in a way that allows them to collectively form a flange feature 16 having a leftwardly extending base 18 and a rightwardly-extending base 20. The bases 18, 20 may then be secured to a substrate 22, such as a straight tape, a life raft surface, other T-tapes, or to any other surface. Various methods for forming the T-shaped configuration 10, as well as methods for its use in securement of raft components to one another are provided herein.

Non-limiting examples of materials that may be used to form the T-shaped construction may be nylon, polyurethane, vinyl, polyvinyl chloride (PVC), any woven, non-woven, knitted, or film-based substrate, any combinations thereof, or any other appropriate materials. It should be understood that the industry is exploring other materials in connection with life rafts and other inflatable structures, and that such materials may be used to form the structures described herein. The material may have a coating on both sides, on only on side, or it may be uncoated. If one or more coatings are provided, they may provide bonding, welding, or abrasion resistance, or other properties. In a specific embodiment, the material may be a polyurethane-coated nylon. In a specific example, the nylon may be coated on both sides with polyurethane. In another specific embodiment, the material may be neoprene coated. In another specific embodiment, the material may be a woven nylon with one or more marine-based coatings that protect the material from salt and other potentially corrosive atmospheric conditions. In another specific embodiment, the material may be any appropriate material that is used in a marine operation, such as materials used to form life jackets, materials used to form life rings, or any other appropriate materials.

As shown in FIG. 2, a first portion 12 of tape material is provided. This portion 12 has an upper face 24 and a lower face 26. The portion 12 is folded so that its upper face 24 doubles back upon itself, as shown in FIG. 2A. In a specific embodiment, the portion 12 may be folded in half so that one half 12*b* folds upon another half 12*a*. A second portion 14 of tape material is then secured to the lower face 26 of half 12*b*. In one embodiment, the second portion similarly has an upper face 28 and a lower face 30, as well as halves 14*a* and 14*b*. As shown in FIG. 2B, the lower face 30 of half 14*b* may be secured to the lower face 26 of half 12*b*. This leaves half 14*a* to trail.

Figure 2A:
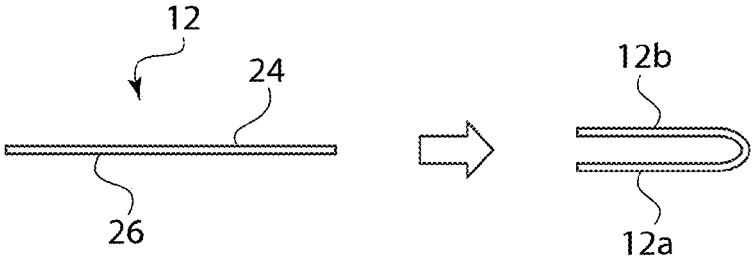
FIGS. 2A-D show a schematic of one embodiment of a method for forming a T-tape configuration.
Figure 2B:
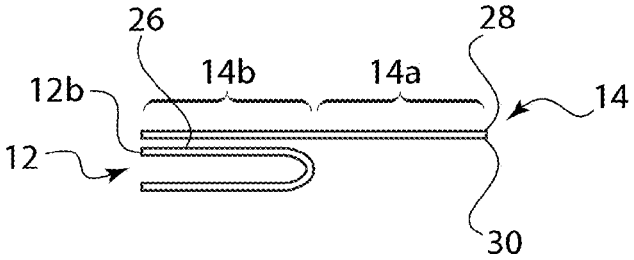
Figure 2C:
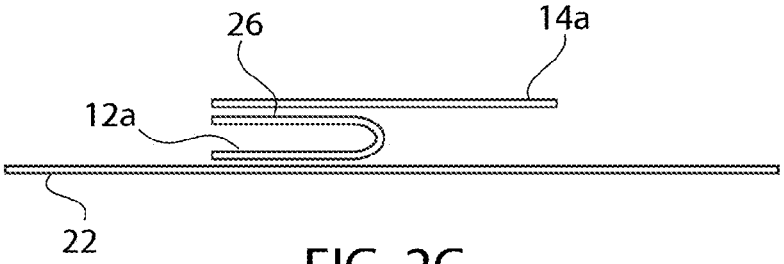
Figure 2D:
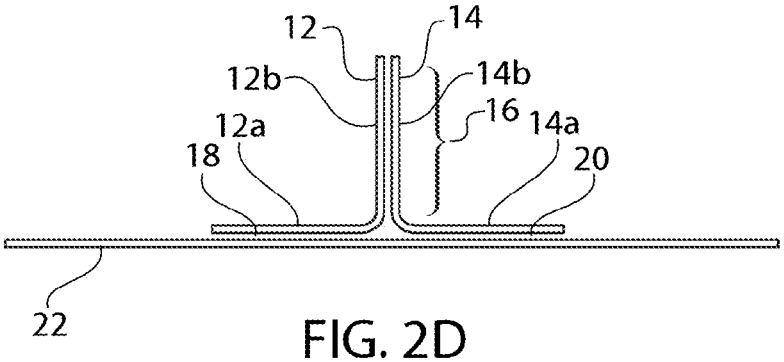

As shown in FIG. 2C, the lower face 26 of portion 12*a* may be secured to a raft panel, straight tape, additional T-tapes, or any other substrate 22. In a specific embodiment, this securement is via welding. This can include using hot air, heated dies, high frequency electromagnetic waves (RF welding), ultrasonic acoustic vibrations (ultrasonic welding) to melt or soften the fabric of the tape and/or the raft panel or substrate so that the two are welded to one another in a secure connection. Alternatively, this securement may be via any appropriate adhesive or any other component. As shown in FIG. 2D, the T-tape can then be opened and the trailing end 14*a* may be similarly welded (or otherwise secured) to the raft panel or other substrate 22. This creates a protruding flange feature 16 on the raft panel or other substrate 22.

The material may be provided in any desired width or length. Non-limiting examples include a tape-like material that is about 0.25 to about six inches wide. In a specific embodiment, the tape may be about 1½ inch wide. In one example, the width of the tape may be any width that will create a flange feature 16 of the desired height. Because the flange is about half the width of each individual tape portion used to form the T-tape, if a flange 16 of one inch is desired, then the two tape portions 12, 14 should be about two inches wide. If a flange 16 of 0.75 inch is desired, then the two tape portions 12, 14 should be about 1.5 inches wide. Likewise, if a flange of three inches is desired, then the two tape portions 12, 14 should be about six inches wide each, and so forth. In one embodiment, the length of the tape may be any length that will generally allow the tape to track the circumference of the raft. This may result in a T-tape that is several yards long. Alternatively, if the T-tape is to be used to secure the floor to the raft components, then its length may be less. In one specific example, the length of the T-tape may be from about 0.25 inch to about six inches long. As discussed, in a specific embodiment, the length of the T-tape portions 12, 14 may be about 1.25 inches wide, such that the flange is about 0.75 inches long.

Figure 16A:
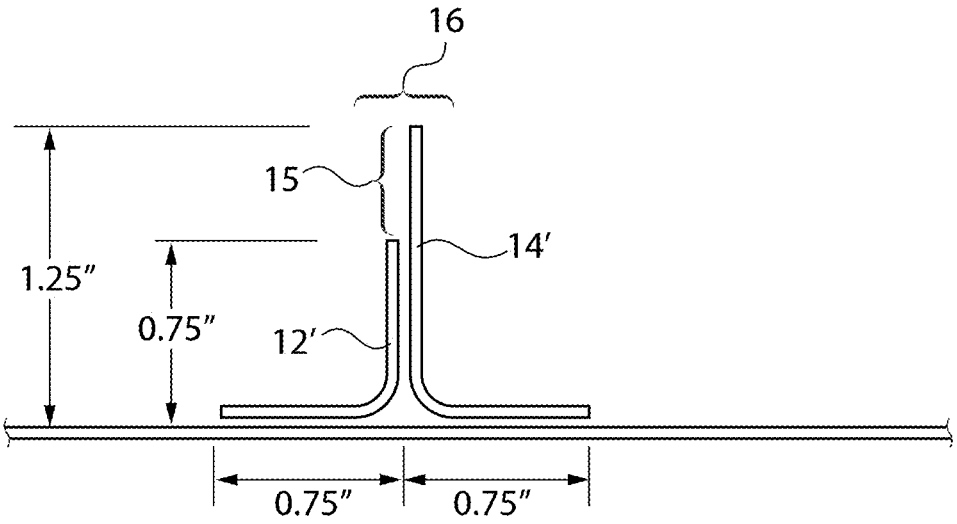
FIG. 16A shows one embodiment of a T-tape having at least one longer portion forming the flange.
Figure 16B:
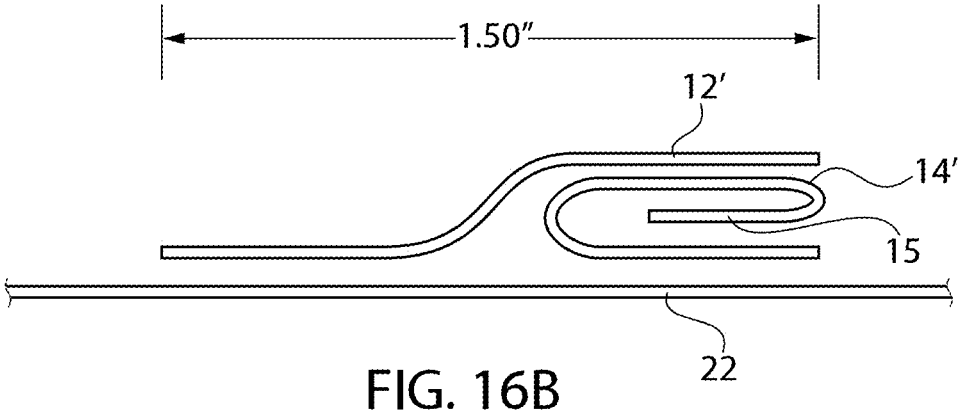
FIG. 16B shows the longer T-tape of FIG. 16A folded upon itself.

It is also possible for the portions 12, 14 to be different lengths in order to provide similarly shaped left and right bases 18, 20, but to provide a longer flange 16'. FIG. 16A shows a first portion 12' that has a first width, and a second portion 14' that has a longer width. In the example shown, the first portion is 1.25 inches wide and the second portion 14' is two inches wide. This allows the base portion to be the desired 1.5 inches long (which may be optimal based on federal regulation requirements for tube/tube and tube/floor securement strength), but can also allow a longer flange 16' due to the longer length of portion 14'. An upward-extending part 15 of portion 14' may extend a past portion 12', effectively elongating the flange 16'. The first portion 12' may have an upper half and a lower half. The second portion 14' may have an extending portion 15, a connection portion, and a lower portion. The upper half of the first portion 12' may be secured to the connection portion of the second portion 14'. This forms a flange 16' with the extending portion extending therefrom. The lower half of the first portion 12' and the lower portion of the second portion 14' may be splayed so that they contact as substrate 22 as outlined above. FIG. 16B shows that part 15 may be folded upon itself if the flange 16' is folded down or otherwise pressed against a substrate 22. Although exemplary dimensions are shown and described, it should be understood that any possible dimensions may be used. This longer flange 16' can provide benefits with respect to the manufacturing processes described further below.

Figure 3:
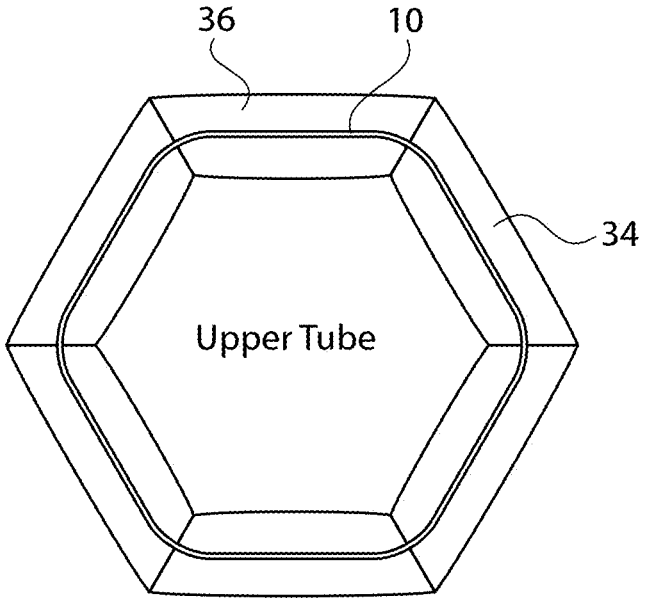
FIG. 3 shows a lower plan view of an upper tube having a T-tape configuration applied to its lower circumference.
Figure 4:
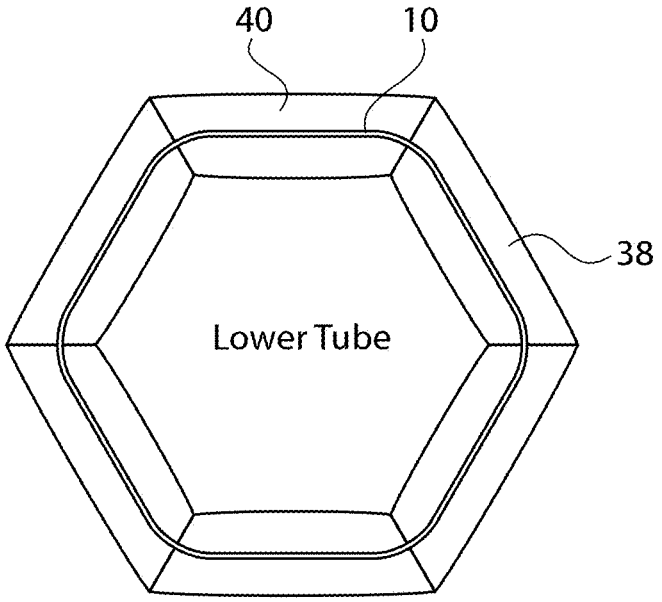
FIG. 4 shows a top plan view of a lower tube having a T-tape configuration applied to its upper circumference.
Figure 12:
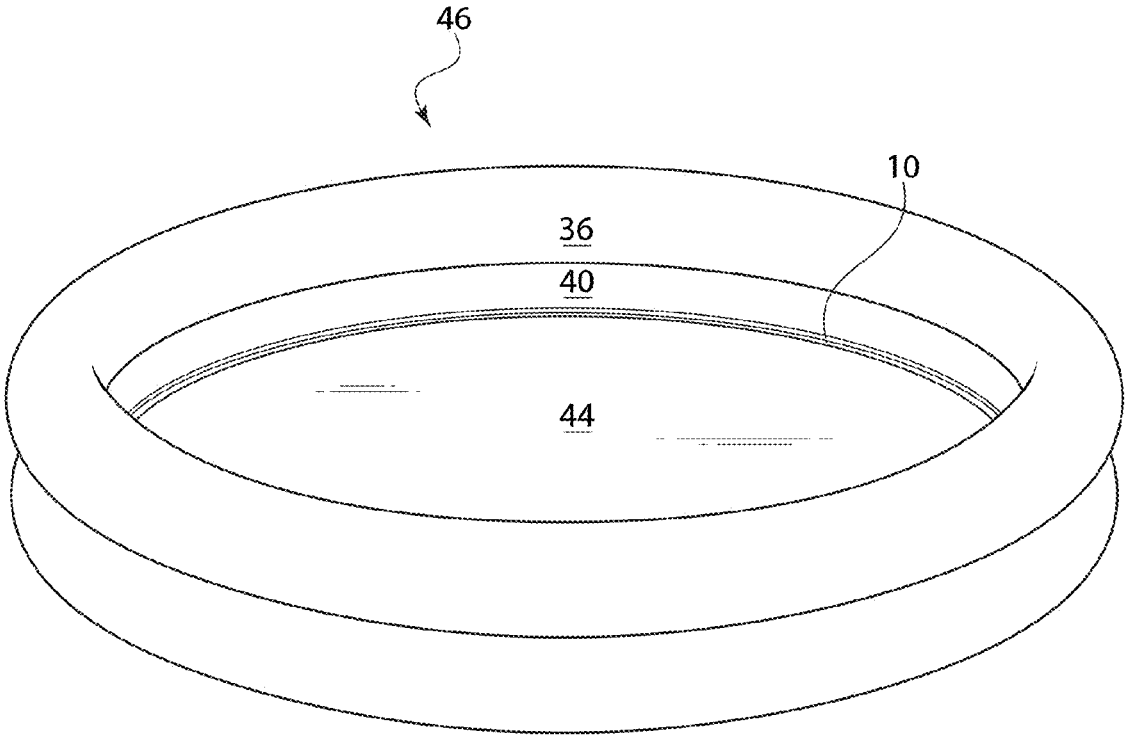
FIG. 12 shows an alternate embodiment of a life raft shape, as well as a life raft floor secured to the lower tube.
Figure 13A:
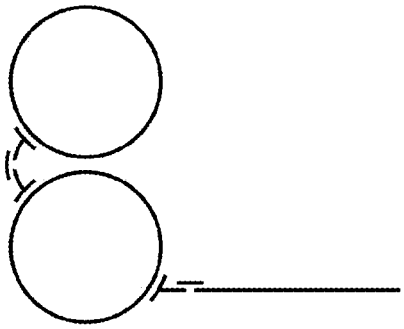
FIG. 13A shows one embodiment with tube assemblies that are secured to one another via a T-tape at an out-board location, and having a floor secured to the lower tube at an in-board location.
Figure 14A:
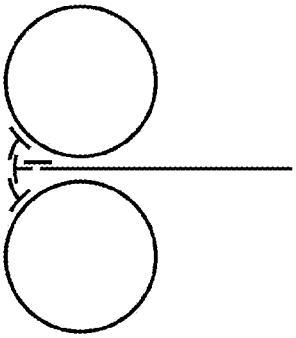
FIG. 14A shows one embodiment with tube assemblies that are secured to one another via a T-tape at an out-board location, and having a floor secured between the tubes at the out-board location.

FIG. 3 shows a T-tape 10 secured around a lower circumference 34 of a first raft tube 36. This may be an upper raft tube. FIG. 4 shows a T-tape 10 secured around an upper circumference 38 of a second raft tube 40. This may be a lower raft tube. The raft tubes are shown as generally hexagon shaped, but it should be understood that they may be any shape, such as circle shaped, oval shaped, square shaped, or any other option. (For example, a circular raft assembly is shown in FIG. 12.) The T-tape 10 may be welded around the circumference or perimeter of one or more tubes. The T-tape 10 may be positioned anywhere along the tube. For example, as shown in FIGS. 13A and 14A, the T-tape may be positioned at an outboard location. This means that the tape may be secured toward an outer edge of each of the rafts, such that the connection or securement line of the raft tubes occurs along an outer, outboard area. This configuration has been found to be particularly beneficial with rafts having a circular shape. This configuration may help keep the tubes from rolling with respect to one another.

Figure 13B:
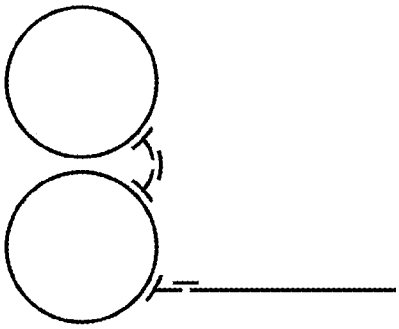
FIG. 13B shows one embodiment with tube assemblies that are secured to one another via a T-tape at an in-board location, and having a floor secured to the lower tube at an in-board location.
Figure 14B:
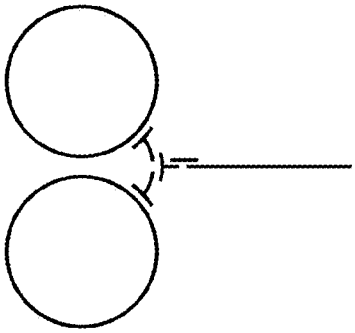
FIG. 14B shows one embodiment with tube assemblies that are secured to one another via a T-tape at an in-board location, and having a floor secured between the tubes at the in-board location.

Another example is shown in FIGS. 13B and 14B, in which the T-tape may be positioned at an inboard location. This means that the tape may be secured toward an inner edge of each of the rafts, such that the connection or securement line of the raft tubes occurs along an inner, in-board area. This configuration may use less fabric than the outboard embodiment. This configuration has been found to be particularly beneficial with rafts having a hexagonal shape. It is also possible for the tape to be positioned along a top center-line or bottom center-line of the raft tubes, as shown in FIGS. 3 and 4. In other embodiments, the T-tape may be welded in one or more discrete sections to one or more tubes, rather than being provided as an integral, single connection line/point.

The raised flange feature 16 created by each T-tape can help provide a securement function. In one aspect, the securement function can be to secure the two raft tubes 36, 40 to one another. In another aspect, the securement function can be used to secure a floor in order to complete the life raft assembly. These two securement functions may be used together or separately.

Figure 5:
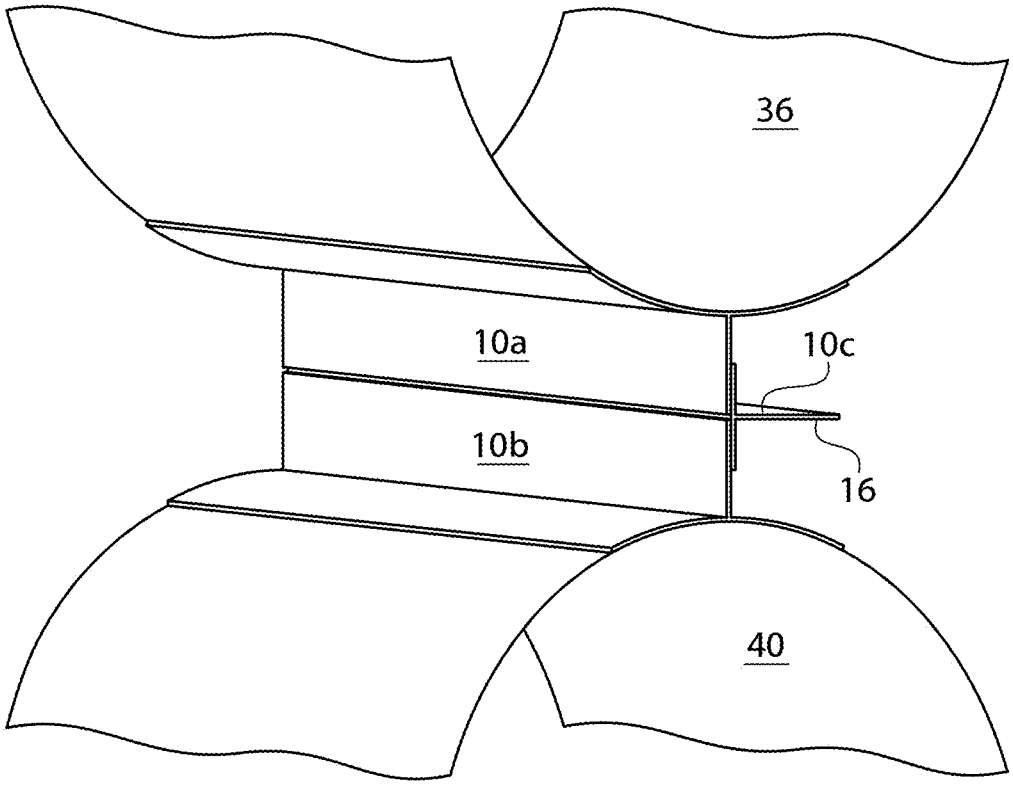
FIG. 5 shows a perspective view of two tubes secured via T-tapes and a third T-tape extended therefrom for securement of a floor thereto.
Figure 6:
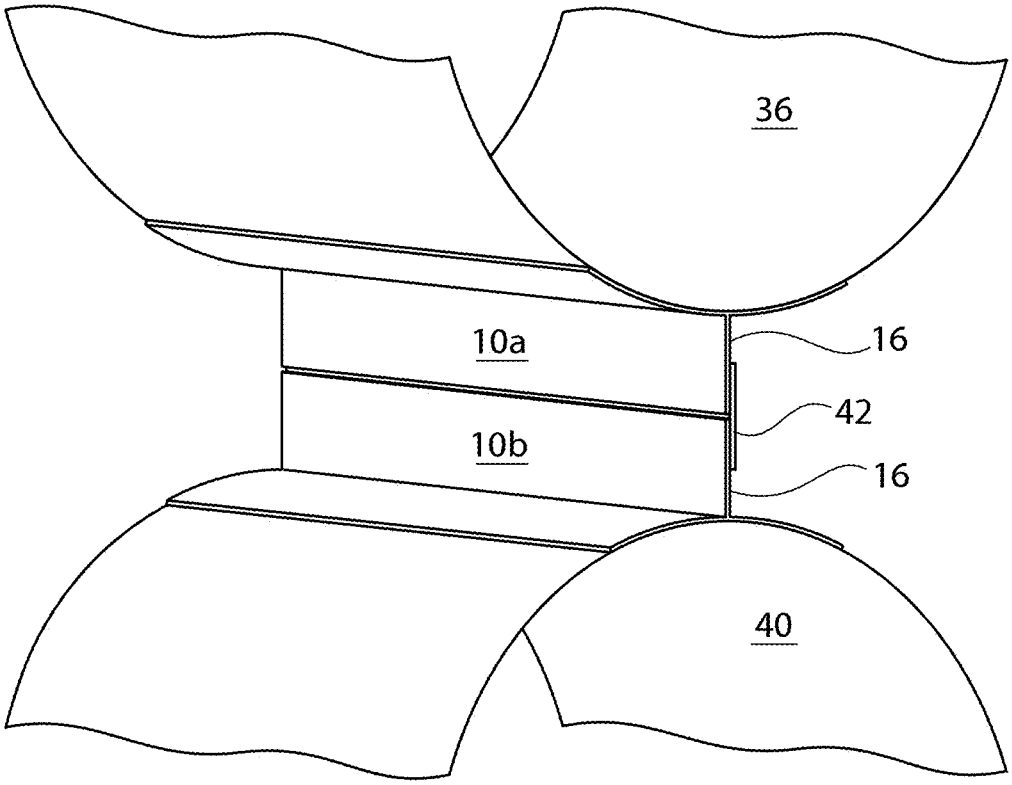
FIG. 6 shows a perspective view of two tubes secured via T-tapes and a straight tape secured thereto.

FIG. 5 shows one embodiment that secures a first tube 36 (which may be referred to as an upper tube 36 for the sake of directionality related to the figures) to a second tube 40 (which may be referred to as a lower tube 40 for the sake of directionality related to the figures). As shown, a first T-tape 10*a* may be secured to the upper tube 36, and a second T-tape 10*b* may be secured to the lower tube 40. A third T-tape 10*c* may be used in order to join the tubes 36, 40 to one another. The third T-tape 10*c* may be manufactured as described above. However, instead of being secured to one of the raft tubes as the substrate, it may be secured to T-tapes 10*a* and 10*b* that extend from the tubes. The T-tapes 10*a* and 10*b* may be overlapped or they may directly abut one another. As shown in FIG. 6, it may be desirable to first use a single straight tape 42 to join the T-tapes 10*a* and 10*b*. This can connect the T-tape flanges 16 with a single tape along a single line, in order to ease securement of the third T-tape 10*c* to the single tape 42. Whichever method is used, the third T-tape 10*c* provides securement of the raft tubes 36, 40 to one another. The third T-tape 10*c* also provides a flange feature 16 for securement of a raft floor 44. As described above, the raft tubes may be connected at any location along the tubes, such as at the outboard area, the inboard area, along the centerline, or anywhere therebetween.

Figure 7:
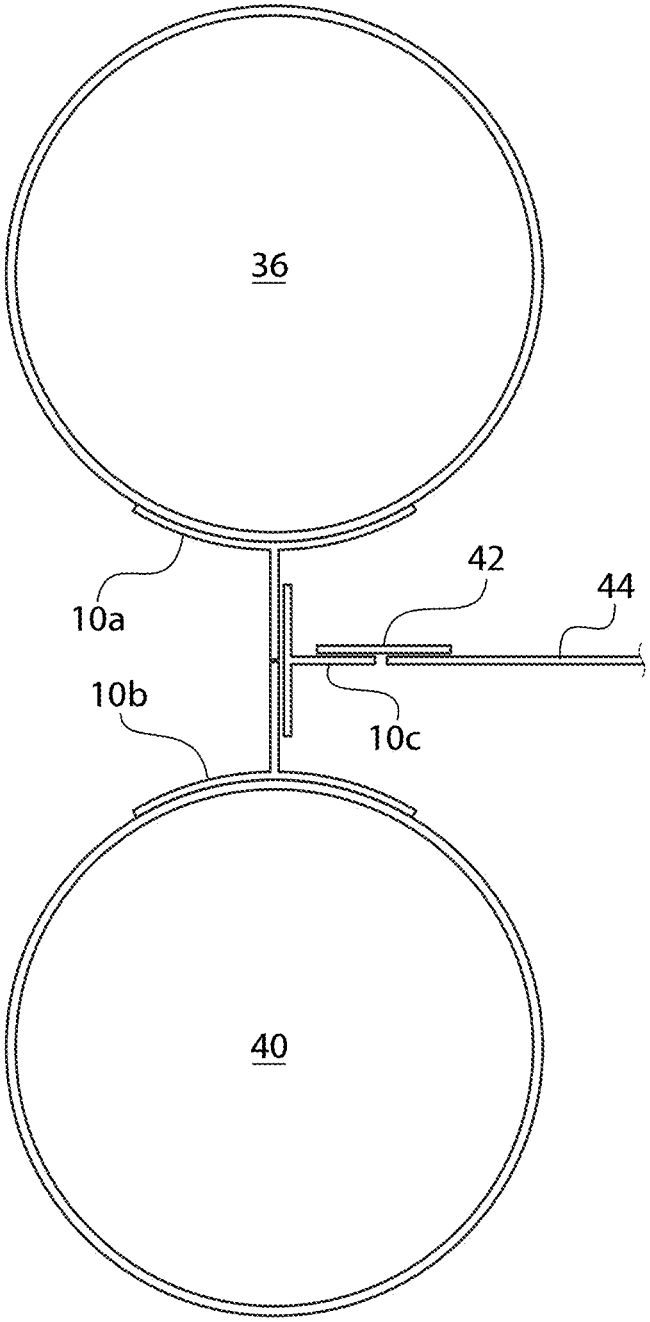
FIG. 7 shows a perspective view of two tubes secured via T-tapes with a floor being secured to a third T-tape.

As shown in FIGS. 1 and 7, a raft floor 44 may be secured to the third T-tape 10*c*. As background, life rafts above a certain size are desirably provided so that they are reversible. There should not be a top or a bottom. This is primarily because larger life rafts are difficult, if not impossible, to manually flip over once deployed. For example, if a 25-person life raft had a true upper side and a lower side, and if it were to be inflated upside down, the crew members and passengers trying to escape the vessel or aircraft would not easily be able to invert or flip the raft. Accordingly, the floor 44 is generally positioned in between first and second raft tubes 36 and 40. (This has been found to be less of an issue for smaller life rafts. According to most relevant federal regulations, life rafts that hold fewer than 25 people may have the floor secured to the lower raft tube, an embodiment for which is outlined in more detail further below.)

Figure 8:
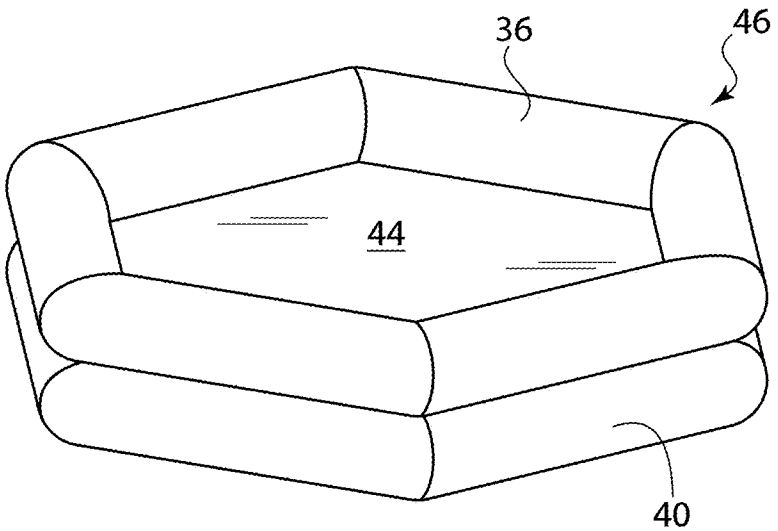
FIG. 8 shows a perspective view of a completed life raft assembly.
Figure 9:
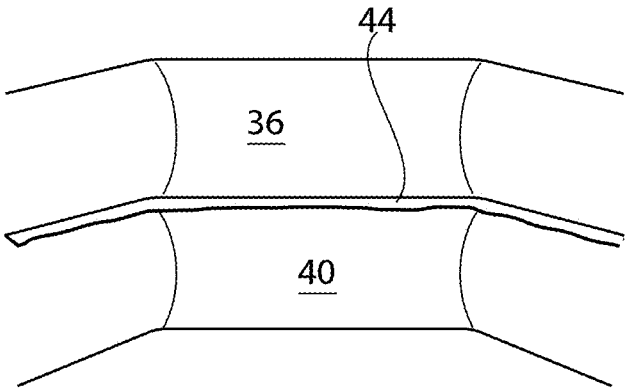
FIG. 9 shows a cross-sectional view of the life raft assembly of FIG. 8, showing the position of the floor in between the two tubes.

In order to position the life raft floor 44 between the rafts tubes 36, 40, a straight tape 42 may be secured between the T-tape 10*c* and the floor 44 in order to secure the floor 44 to the T-tape 10*c* (and consequently, to the raft tubes 36, 40). These securements may generally be via welding. Non-limiting examples include hot air welding, heated die welding, ultrasonic welding, RF welding, or any other forms of welding that can secured the fabrics to one another. In other embodiments, these securements may be via adhesive, cement, glue, stitching, or any other appropriate securement. Because the straight tape 42, the T-tape 10*c*, and the floor 44 are all secured in shear, the shear forces required to separate the components are very high. Such forces may be generally higher than the tear strength of the fabrics used. This results in a secure attachment of the floor 44 to the raft assembly. A completed raft assembly 46 with the floor 44 positioned between tubes 36 and 40 is shown in FIG. 8. FIG. 9 illustrates a cross-sectional view of the raft assembly 46, with the floor 44 between tubes 36, 40.

The floor 44 may be made from any appropriate material, non-limiting examples of which include nylon substrates and other appropriate or approved materials for life raft floors. The materials used are generally very strong and tear resistant. In some embodiments, the material may withstand up to about 300 pounds per square inch.

The floor 44 may be positioned anywhere along the area in between the tubes. For example, as shown in FIG. 14A, the floor may be positioned at an outboard location. In this embodiment, the outboard T-tape (secured toward an outer edge of each of the rafts) that is used to secure the raft tubes to one another may also be the tape that is used to secure the floor in place, such that the floor extends from an outboard location. Another example is shown in FIG. 14B, in which the inboard T-tape (secured toward an inner edge of each of the rafts) that is used to secure the raft tubes to one another may also be the tape that is used to secure the floor in place, such that the floor extends from an inboard location. In other embodiments, the T-tape may be welded in one or more discrete sections to one or more tubes, rather than being provided as an integral, single connection line/point.

Figure 10:
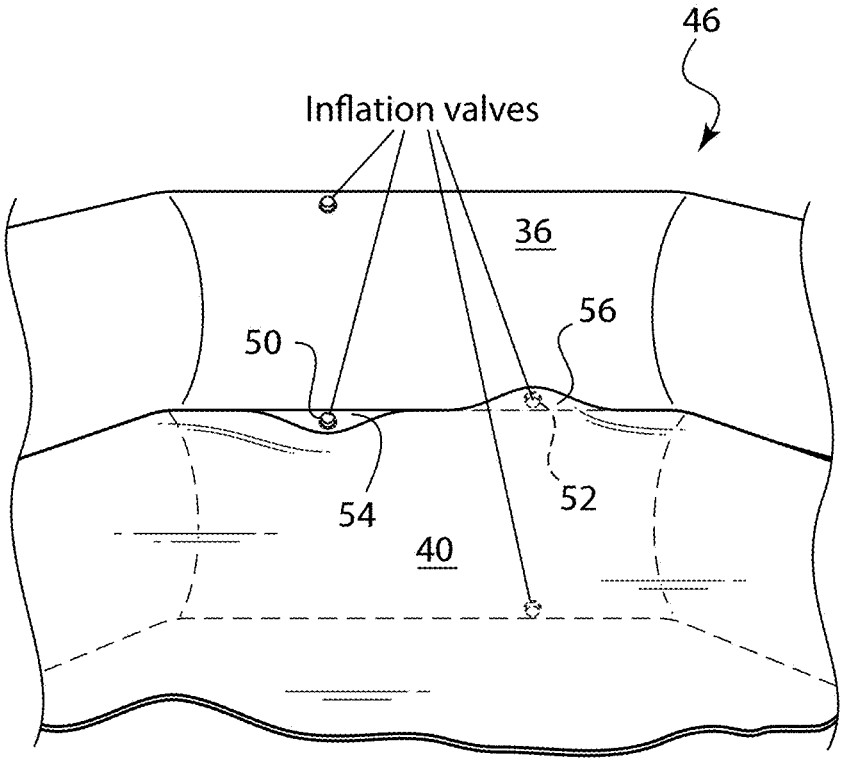
FIG. 10 shows the inflation valves that are used to manually inflate the life raft and the floor transitioning below the lower tube inflation valve and above the upper tube inflation valve.

It has been determined that one challenge with securing the floor 44 in between the tubes 36, 40 may be access to the inflation valves. For example, once the raft assembly is inflated and passengers are on the raft awaiting rescue, it is possible that air may leak from one or more of the tubes. In this instance, the raft is provided with a survival kit that includes a hand pump for inflating the tubes. However, access to the inflation valves can be a challenge. If the leak is in the upper tube (as inflated and deployed, because the assembly with a mid-floor is reversible), access to the inflation valve is generally easy. However, if the leak is in the lower tube as inflated and deployed, access to the inflation valve would be near impossible—it would be below the life raft floor 44. Accordingly, there is provided a T-tape transfer configuration and method, as shown in FIG. 10. This transfer configuration and method was developed to provide access to the both inflation valves 50, 52 from either side of the raft assembly 46 as deployed.

As shown, rather than securing the floor 44 directly in the middle between the raft tubes across the entire assembly 46, the floor 44 is caused to dip in at least one dip section 54 and caused to rise in at least one rise section 56. This may occur in order to allow access to either inflation valve 50 or 52 from either side of the raft assembly 46. In a particular embodiment, the T-tape portions that are secured to the tubes 36, 40 are caused to create a dip section 54 that allows access to the lower raft tube inflation valve 52 for occupants seated on a raft with tube 36 forming the upper tube. Near that section or at another section along the raft assembly, the T-tape portions are caused to create a rise section 56 that allows access to the other raft tube inflation valve 50 for occupants seated on a raft with tube 40 forming the upper tube. This allows the welding/securing process of the T-tape to the raft assembly to be continuous for completion of the raft without stopping the attachment process. In one embodiment, the T-tape sections that are applied to the raft tubes run generally aligned with one another so that they can both swoop up together to create an access for a first inflation tube at one location and can then swoop down together in order to create an access for a second inflation tube at a second location.

If the floor 44 will not be secured between the tubes 36, 40 but to the bottom of one of the tubes 36, 40, then the tubes may be secured to one another as shown in FIG. 6. A straight tape 42 may be applied against T-tapes 10*a* and 10*b*. The T-tapes 10*a* and 10*b* may overlap one another or they may abut one another. In either option, the straight tape 42 may be welded, adhered, or otherwise secured in place to secure the T-tapes in place with respect to one another.

Figure 11:
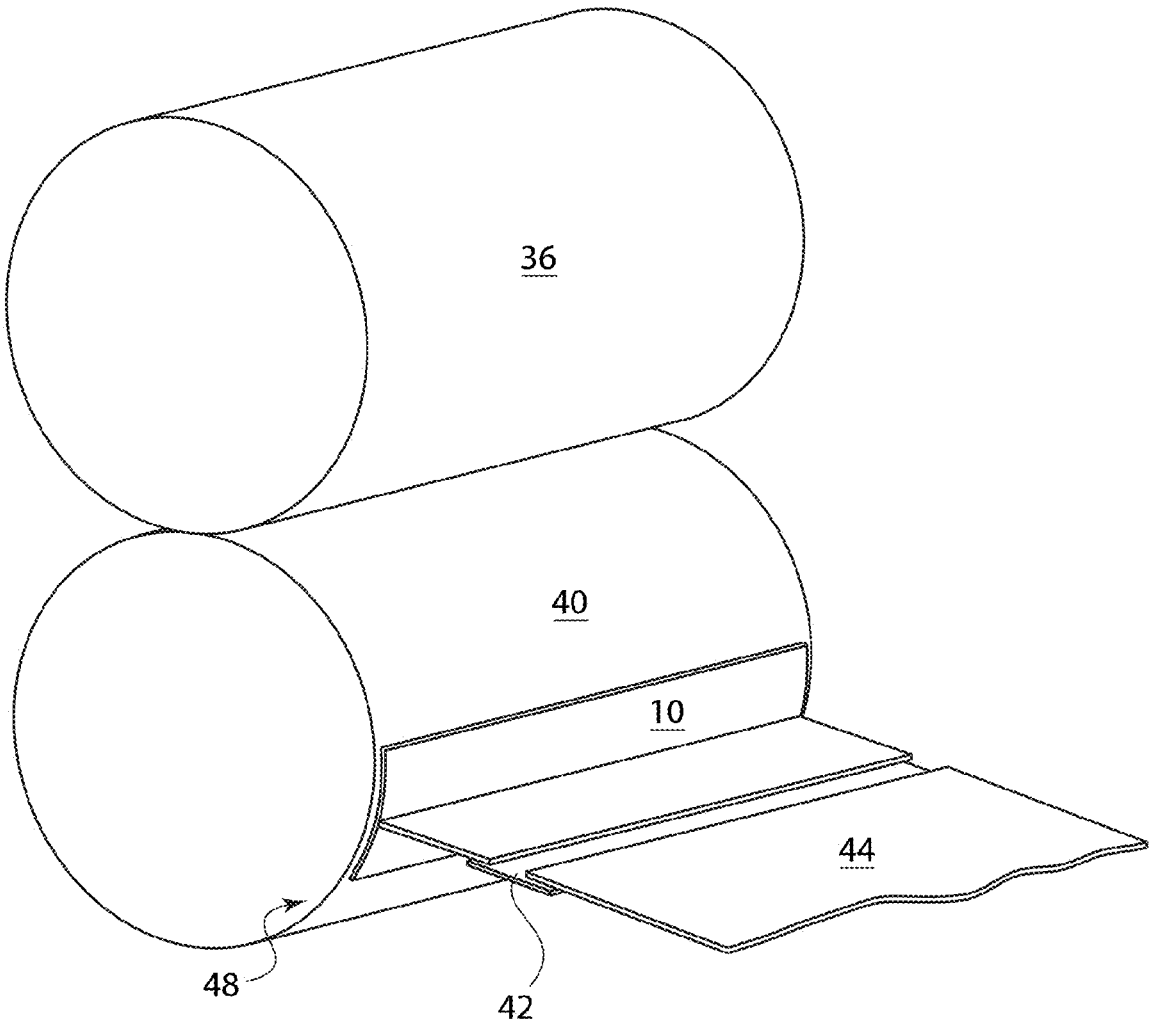
FIG. 11 shows a life raft floor secured to a lower tube.

As mentioned above, the life raft floor 44 for smaller life rafts may be applied to a lower tube, so that the floor is positioned along the bottom of the raft assembly 46, as shown in FIG. 11. In this embodiment, the raft tubes 36, 40 may be secured in any appropriate manner. For example, they may be secured using the T-tape 10 options described above and as shown in FIGS. 2-3 and 5. In another embodiment, the tubes may be secured via any other method, including but not limited to direct welding of the tubes, adhesive securement between the tubes, or any other securement method. Whatever method is used to secure the tubes, the following method may be used to secure the life raft floor 44 to a lower tube 40. A T-tape 10 may be secured to a lower tube as outlined above. The T-tape 10 may be secured at or near a base portion 48 of the tube 40.

Figure 15A:
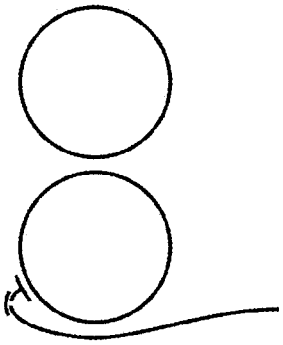
FIG. 15A shows one embodiment with tube assemblies having a floor secured to the lower tube at an out-board location.
Figure 15B:
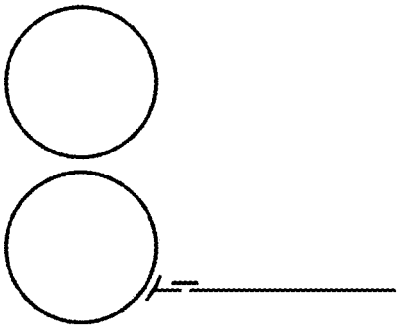
FIG. 15B shows one embodiment with tube assemblies having a floor secured to the lower tube at an in-board location.

For example, as shown in FIG. 15A, the floor may be positioned at an outboard location. In this embodiment, an outboard T-tape may be secured to an outer edge of the lower raft in order to secure the floor in place, such that the floor extends below the lower tube from an outboard location. Another example is shown in FIG. 15B, in which an inboard T-tape may be secured to an inner edge of the lower raft in order to secure the floor in place, such that the floor extends from an inboard location. Although not shown, the T-tape may be secured to a lower centerline portion of the lower raft or at any other location along the lower raft tube 40.

In a specific embodiment, the T-tape 10 may be secured around an interior, lower base area of the tube as shown in FIG. 11. A straight tape 42 may then be secured between the flange 16 of the T-tape 10 and the floor 44 in order to secure the floor 44 to the T-tape 10 (and consequently, to the raft tubes 36, 40). The straight tape 42 may be installed on the top or bottom surface of flange 16.

Figure 17:
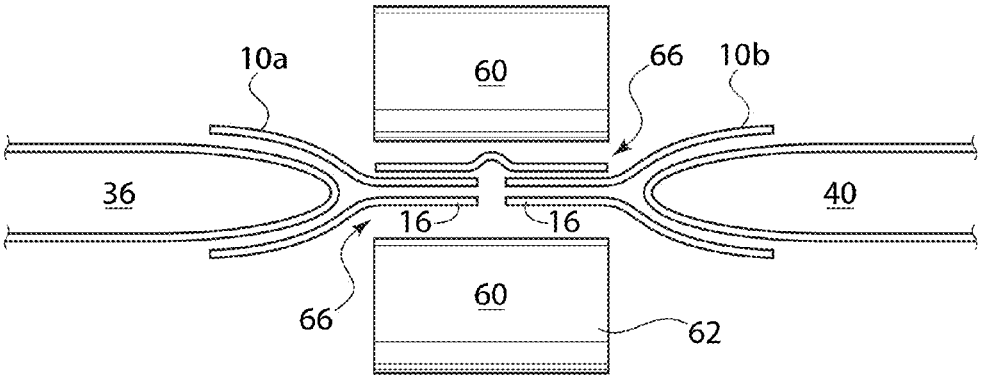
FIG. 17 shows a schematic view of a machine that may be used to form and attached tubes to one another, attaching tubes using a T-tape of FIG. 2D.
Figure 18:
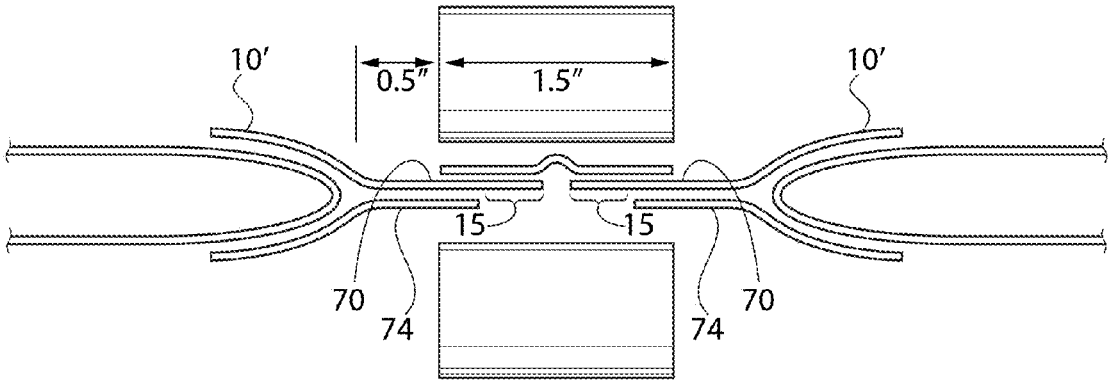
FIG. 18 shows a schematic view of the machine of FIG. 17, attaching tubes using a longer T-tape of FIG. 16A.

FIGS. 17 and 18 show examples of how a machine can create securement between T-tapes secured to raft tubes. FIG. 17 shows a first T-tape 10*a* secured to a first tube 36 and a second T-tape 10*b* secured to a second tube 40. The machine may include two rollers 60 that apply pressure and heat to the T-tapes 10*a*, 10*b*. In the embodiment shown, a single tape 42 is used to secure T-tapes 10*a*, 10*b* to one another. This image shows the possibility of pinch point areas 66, where the T-tape flanges 16 may possibly get lodged with respect to the rollers 60 and pull the tube portions into the rollers as well. In this instance, a longer T-tape embodiment of FIG. 16A may be useful.

As shown in FIG. 18, if a longer T-tape 10' is used, the extended part 15 of the flange 16' may provide a buffer at what may have caused a pinch point area 66 in FIG. 17. This embodiment prevents any portions of the tubes from becoming pressed or sealed by the rollers 60.

Regarding the various possible coatings that may be applied to the T-tape discussed above, it may be desirable to provide a coating on the surface that is to be welded to the single tape 42 or other substrate. In FIG. 18, this is the upper surface 70 of the tape. In FIG. 18, this is the longer leg 15 of the T-tape. This coating can help with welding or abrasion resistance. The lower surface 74 of the T-tapes may be coated or uncoated.

Figure 19:
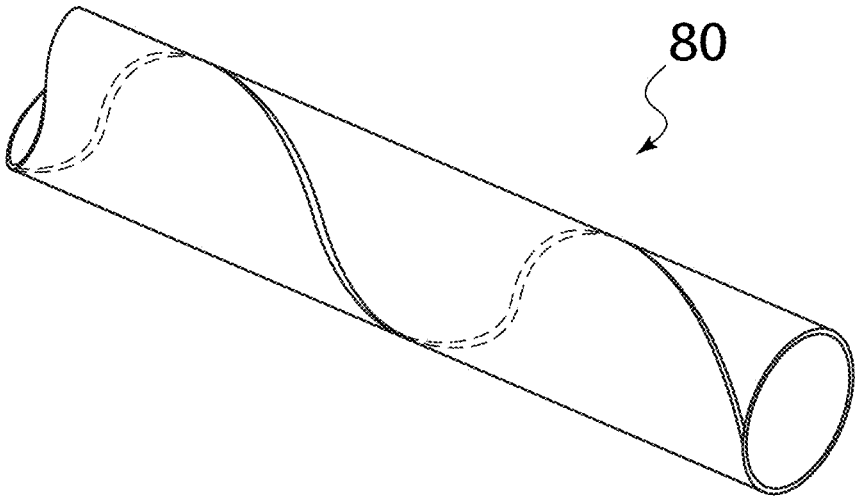
FIG. 19 shows a perspective view of a tube that may be formed using a spiral method.
Figure 20:
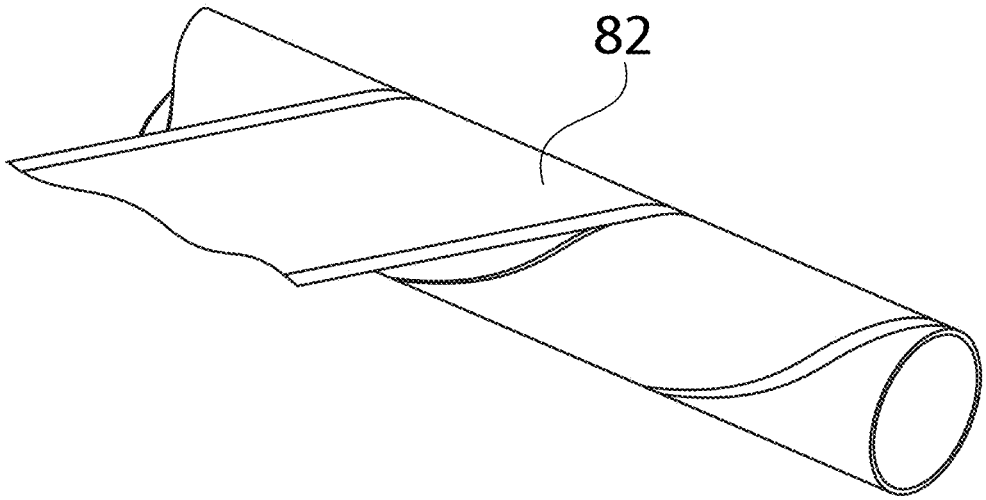
FIG. 20 shows a perspective view of a material being would in a spiral configuration to form the tube of FIG. 19.

FIGS. 19 and 20 show a tube manufacturing method that may be used with the T-tapes described herein. One of the benefits of the T-tapes provided is that they can be used for a cement-less securement of the raft tubes and/or floors. This cement-less technology can also be beneficial if used in conjunction with a tube manufactured via a spiral seam. Examples of such tubes and methods are outlined in U.S. Pat. No. 6,199,676. An inflatable tubular structure 80 may be constructed using an elongate, flexible strip of fabric 82 (of any of the types outlined above) that is spiraled into a tubular shape. The fabric may be bonded or welded or otherwise secured upon itself as it is wound to form a spiral seam. This is similar in concept to a dough package or toilet paper roll form, which are formed from wound paperboard to create a spiral seam. Once the tube 80 is formed as shown in FIGS. 19 and 20, one or more T-tapes may be secured to the tubes as outlined in this disclosure.

Example 1

A life raft assembly comprising a first tube 36, a second tube 40, and a floor 44, with the first and second tubes being secured to one another via first and second life raft securing components. The floor 44 may be secured relative to the first and second tubes via a third life raft securing component. Each life raft securing component may be formed as T-shaped configuration forming a flange feature 16 and a connection base 18, 20, wherein the first tube comprises a first life raft securing component 10*a* secured thereto and wherein the second tube comprises a second life raft securing component 10*b* secured thereto. The flange features 16 of the first and second life raft securing components are secured to one another via the connection base 18, 20 of the third life raft securing component 10*c*. The flange 16 of the third life raft securing component 10*c* may be secured to the floor 44.

This securement may be via a tape portion 42 securing the first and second life raft securing components to one another.

The third life raft securing component may provide an attachment point for securing the floor 44 to the first and second life raft securing components 10*a*, 10*b*.

In one example, the first and second life raft securing components 10*a* and 10*b* may be generally aligned with one another and comprise at least one dip section 54 and at least one rise section 56 to allow access to inflation valves 50, 52 of both the first and second life tubes 36, 40.

The first and second life raft securing components may be secured around a circumference of each of the first and second tubes.

The first and second life raft securing components may comprise nylon, polyurethane, vinyl, polyvinyl chloride, a woven fabric, a non-woven fabric, a knitted fabric, a film-based substrate, or any combination thereof.

The first and second life raft securing components may have a coating on both sides, on only on side, or they may be uncoated.

The flange 16 of each of the first and second life raft securing components 10*a*, 10*b* may be about 0.25 to about six inches wide. In a particular embodiment, they may be about 0.75 to about two inches wide. The length of the material forming the life raft securing components may be any length that allows the component to traverse the desired circumference or other dimension of the raft.

Example 2

A life raft securing component comprising a first portion 12' comprising an upper half and a lower half, a second portion 14' having a length that is longer than the first portion, the second portion having an extending portion 15, a connection portion, and a lower portion, the lower half of the first portion and the lower portion of the second portion securable to a substrate 22 in order to form a component base and wherein securement between the upper half of the first portion and the connection portion of the second portion forms a flange with the extending portion extending therefrom.

This life raft securing component can be used in connection with a first tube 36 and a second tube 40, wherein the life raft securing component base 18, 20 secured to the first tube 36, and with a second life raft securing component 10*b* with a base 18, 20 that is secured to the second tube 40.

The life raft securing component flanges 16 may be secured to one another in order to secure the first and second tubes to one another.

A securing tape 42 may be used to secure the flanges to one another.

A third life raft securing component 10*c* may be used to secure the flanges 16 to one another and to provide an additional securement point for a life raft floor 44.

The life raft securing component can be used in connection with a lower tube 40, a life raft floor 44, and a securing tape 42, wherein the life raft securing component 10 is secured to the lower tube 40, and wherein the securing tape 42 secures the life raft floor 44 to the life raft securing component 10.

The life raft securing component may be nylon, polyurethane, vinyl, polyvinyl chloride, a woven fabric, a non-woven fabric, a knitted fabric, a film-based substrate, or any combination thereof. The life raft securing component may have one or more coatings applied to its surface.

Changes and modifications, additions and deletions may be made to the structures and methods recited above and shown in the drawings without departing from the scope or spirit of the invention and the following claims.

What is claimed is:

1. A life raft assembly, comprising:

A first tube, a second tube, and a floor;

the first and second tubes being secured to one another via first and second life raft securing components, the floor being secured relative to the first and second tubes via a third life raft securing component, each life raft securing component comprising a T-shaped configuration forming a flange feature and a connection base, wherein the first tube comprises a first life raft securing component secured thereto and wherein the second tube comprises a second life raft securing component secured thereto, wherein the flange features of the first and second life raft securing components are secured to one another via the connection base of the third life raft securing component, wherein the flange of the third life raft securing component is secured to the floor.

2. The life raft assembly of claim 1, further comprising a tape portion securing the first and second life raft securing components to one another.

3. The life raft assembly of claim 1, wherein the third life raft securing component provides an attachment point for securing the floor to the first and second life raft securing components.

4. The life raft assembly of claim 1, wherein the first and second life raft securing components are generally aligned with one another and comprise at least one dip section and at least one rise section to allow access to inflation valves of both the first and second life tubes.

5. The life raft assembly of claim 1, wherein the first and second life raft securing components are secured around a circumference of each of the first and second tubes.

6. The life raft assembly of claim 1, wherein the first and second life raft securing components comprise nylon, polyurethane, vinyl, polyvinyl chloride, a woven fabric, a non-woven fabric, a knitted fabric, a film-based substrate, or any combination thereof.

7. The life raft assembly of claim 1, wherein the T-shaped configuration comprises one or more coatings applied to one or more surfaces of the T-shaped configuration.

8. The life raft assembly of claim 1, wherein the first and second life raft securing components are secured to outboard surfaces of the first and second tubes.

9. The life raft assembly of claim 1, wherein the first and second life raft securing components are secured to inboard surfaces of the first and second tubes.

10. The life raft assembly of claim 1, wherein at least one of the first and second tubes is formed via an elongate material with a spiral seam.

11. The life raft assembly of claim 1, wherein the flange of each of the first and second life raft securing components is about 0.25 to about six inches long.

12. A life raft securing component, comprising:

a first portion comprising an upper half and a lower half, a second portion having a length that is longer than the first portion, the second portion having an extending portion, a connection portion, and a lower portion, the lower half of the first portion and the lower portion of the second portion securable to a substrate in order to form a component base and wherein securement between the upper half of the first portion and the connection portion of the second portion forms a flange with the extending portion extending therefrom, wherein the life raft securing component flanges are secured to one another in order to secure first and second tubes to one another.

13. The life raft securing component of claim 12, further comprising a securing tape to secure the flanges to one another.

14. The life raft securing component of claim 12, further comprising a third life raft securing component used to secure the flanges to one another and to provide an additional securement point for a life raft floor.

15. The life raft securing component of claim 12, further comprising a lower tube, a life raft floor, and a securing tape, wherein the life raft securing component is secured to the lower tube, and wherein the securing tape secures the life raft floor to the life raft securing component.

16. The life raft securing component of claim 12, comprising one or more coatings applied to one or more surfaces of the life raft securing component.

* * * * *